US006068502A

United States Patent [19]

Kuo

[11] Patent Number: 6,068,502

[45] Date of Patent: May 30, 2000

[54] ELECTRICAL CONNECTOR

[75] Inventor: Peter Kuo, Taipei, Taiwan

[73] Assignee: Hon Hai Precision Ind. Co., Ltd., Taipei Hsien, Taiwan

[21] Appl. No.: 09/416,864

[22] Filed: Oct. 13, 1999

[30] Foreign Application Priority Data

Jul. 2, 1999 [TW] Taiwan ..... 88211061

[51] Int. Cl.[7] ..... H01R 13/627

[52] U.S. Cl. ..... 439/353; 439/92

[58] Field of Search ..... 439/567, 571, 439/572, 607, 609, 610, 939, 350–358, 92

[56] References Cited

U.S. PATENT DOCUMENTS

| | | | |
|---|---|---|---|
| 4,588,854 | 5/1986 | Bailey et al. . | |
| 5,316,500 | 5/1994 | Vanaleck et al. | 439/567 |
| 5,334,049 | 8/1994 | Kachlic et al. | 439/567 |
| 5,518,416 | 5/1996 | Kantner et al. | 439/352 |
| 5,540,598 | 7/1996 | Davis | 439/79 |
| 5,664,965 | 9/1997 | Clark et al. | 439/567 |
| 5,709,556 | 1/1998 | Tan et al. | 439/567 |

*Primary Examiner*—Gary F. Paumen
*Attorney, Agent, or Firm*—Wei Te Chung

[57] ABSTRACT

An electrical connector comprises a body, a metal plate and a shield. The body defines a plurality of passageways for retaining terminals therein. The shield encloses the body and the body has an exposed bottom face for mating with a circuit board. The metal plate surrounds the body, and a pair of board locks is formed on opposite lateral ends of the metal plate. Each board lock comprises a base, a pair of folded portions extending from opposite ends of the base, a leg extending from each folded portion, and a barb formed on a free end of each leg. A resilient plate extends from a central portion of the base. A folded tip is formed on a free end of the resilient plate. When the board lock extends through a receiving hole of another circuit board having a different thickness, the electrical connector is properly secured to the circuit board due to the provision of the resilient plate and the barbs.

3 Claims, 5 Drawing Sheets

ELECTRICAL CONNECTOR

BACKGROUND OF THE INVENTION

The present invention relates to an electrical connector, and particularly to an electrical connector having a metal shield for attaching the electrical connector to circuit boards of different thickness.

An electrical connector is mainly used for transmission of electrical signals between two subsystems, for example a circuit board and a display, a circuit board and a printer, or a circuit board and a scanner. Generally, a conventional electrical connector has a locking element for coupling to a mating electrical connector and ensuring reliable signal transmission therebetween. Related inventions are disclosed in U.S. Pat. Nos. 5,518,416, 5,316,500, 5,540,598 and Taiwan Patent Application Nos. 85216105 and 86102088.

The conventional electrical connector is only suitable for mounting on a circuit board having a particular thickness. An external locking element and a grounding element of the conventional electrical connector are generally separate from each other. Thus, production costs rise, and manufacturing and assembly processes become complicated.

Thus, there is a need for an improved electrical connector having an integrally formed locking element and grounding element which is suitable for being secured to circuit boards of different thickness.

BRIEF SUMMARY OF THE INVENTION

A main object of the present invention is to provide a board lock having an adjustable foot thereby facilitating reliable attachment of a connector to a print circuit board.

Another object of the present invention is to provide an electrical connector having a board lock for adapting to circuit boards with different thickness.

To fulfill the above-mentioned objects, according to a preferred embodiment of present invention, an electrical connector comprises a body, a metal plate and a shield. The body defines a plurality of passageways for retaining terminals therein. The shield encloses the body and the body has an exposed bottom face for mating with a circuit board. The metal plate surrounds the body, and a pair of board locks is formed on opposite lateral ends of the metal plate. Each board lock comprises a base, a pair of folded portions extending from opposite ends of the base, a leg extending from each folded portion, and a barb formed on a free end of each leg. A resilient plate extends from a central portion of the base. A folded tip is formed on a free end of the resilient plate. When the board lock extends through a receiving hole of another circuit board having a different thickness, the electrical connector is properly secured to the circuit board due to the provision of the resilient plate and the barbs.

Other objects, advantages and novel features of the invention will become more apparent from the following detailed description when taken in conjunction with the accompanying drawings.

DETAILED DESCRIPTION OF THE INVENTION

Figure 1:
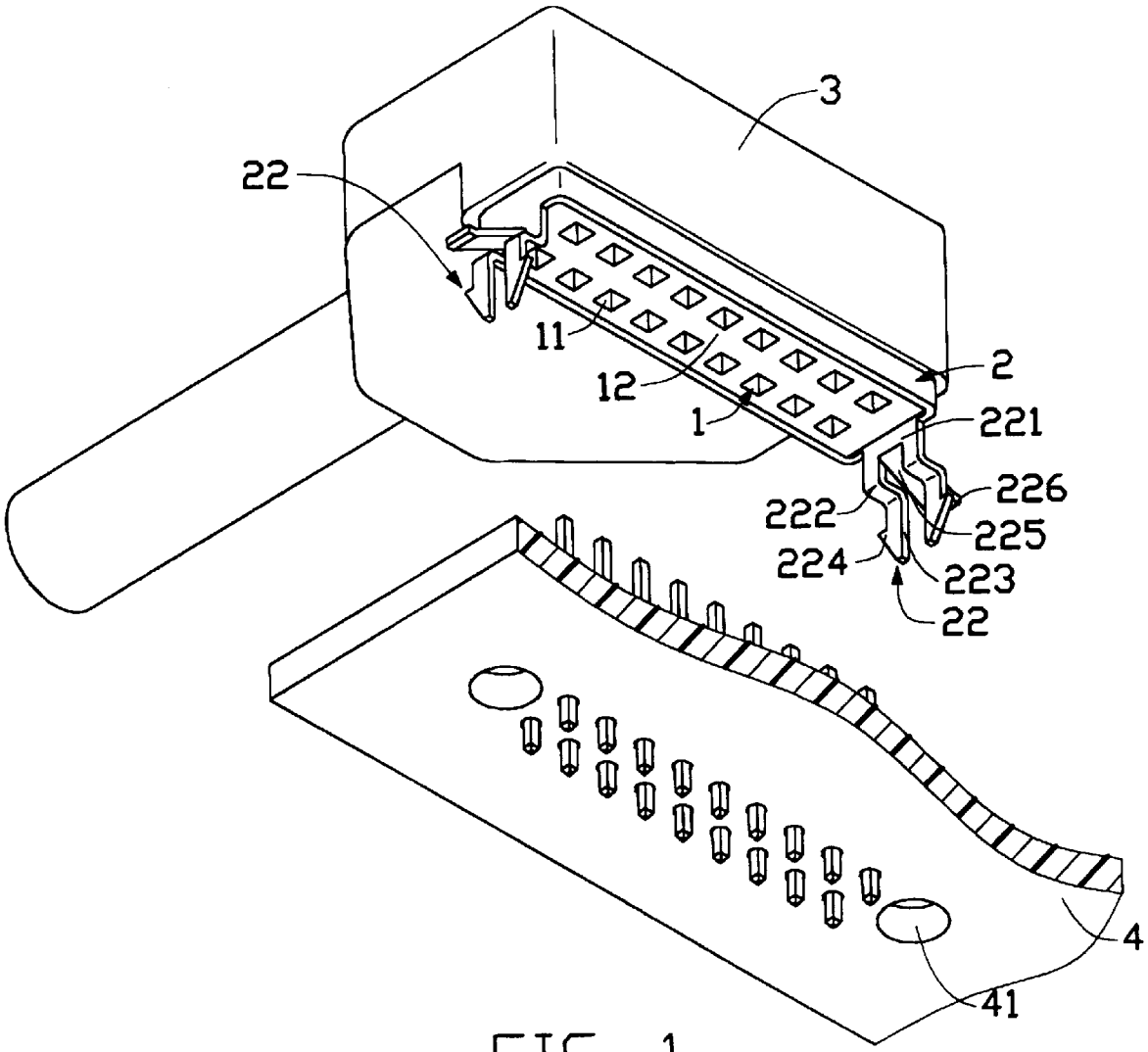
FIG. 1 is a bottom perspective view of an electrical connector in accordance with the present invention and a separate mating plug mounted on a circuit board.
Figure 2:
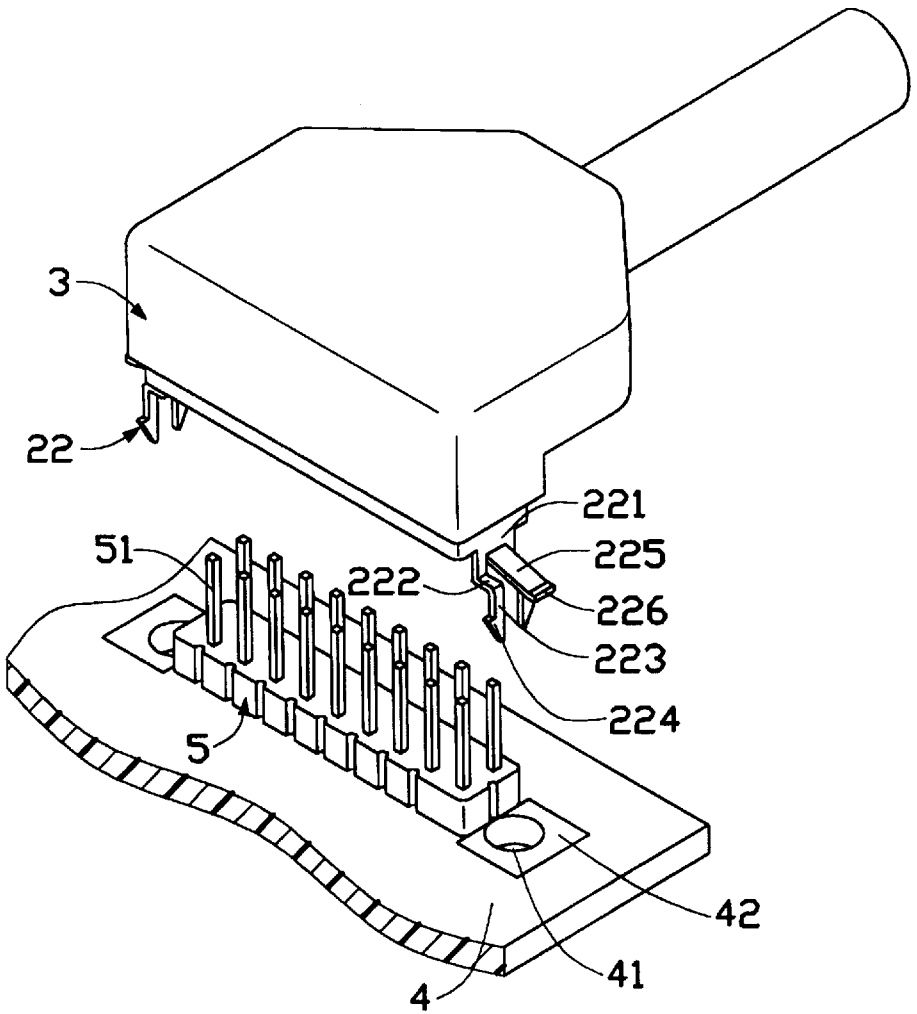
FIG. 2 is a top view of FIG. 1.

Referring to FIGS. 1 and 2, an electrical connector comprises a body 1, a metal plate 2 and a shield 3. The body 1 defines a plurality of passageways 11 for retaining terminals (not shown) therein. The shield 3 defines a receiving space for receiving the body 1 therein, and a bottom face 12 of the body 1 is exposed to mate with a circuit board 4. The metal plate 2 surrounds the body 1, and a pair of board locks 22 is formed on opposite lateral ends of the metal plate 2. Each board lock 22 comprises a base 221, a pair of folded portions 222 extending from opposite ends of the base 221, a leg 223 extending from each folded portion 222, and a barb 224 formed on a free end of each leg 223. A resilient plate 225 extends from a central portion of the base 221. A folded tip 226 is formed on a free end of the resilient plate 225.

Figure 3:
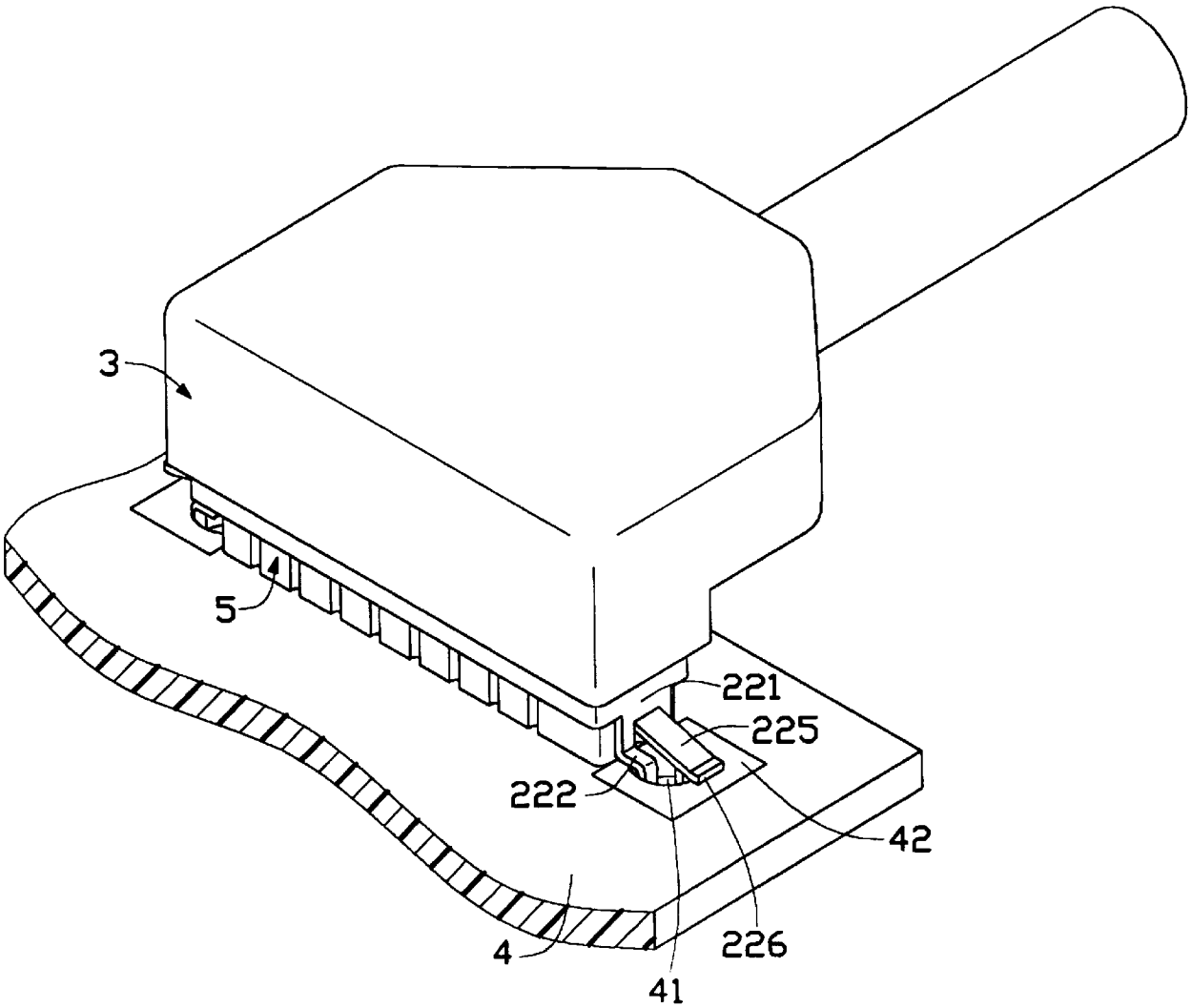
FIG. 3 is an assembled view of FIG. 2.
Figure 4:
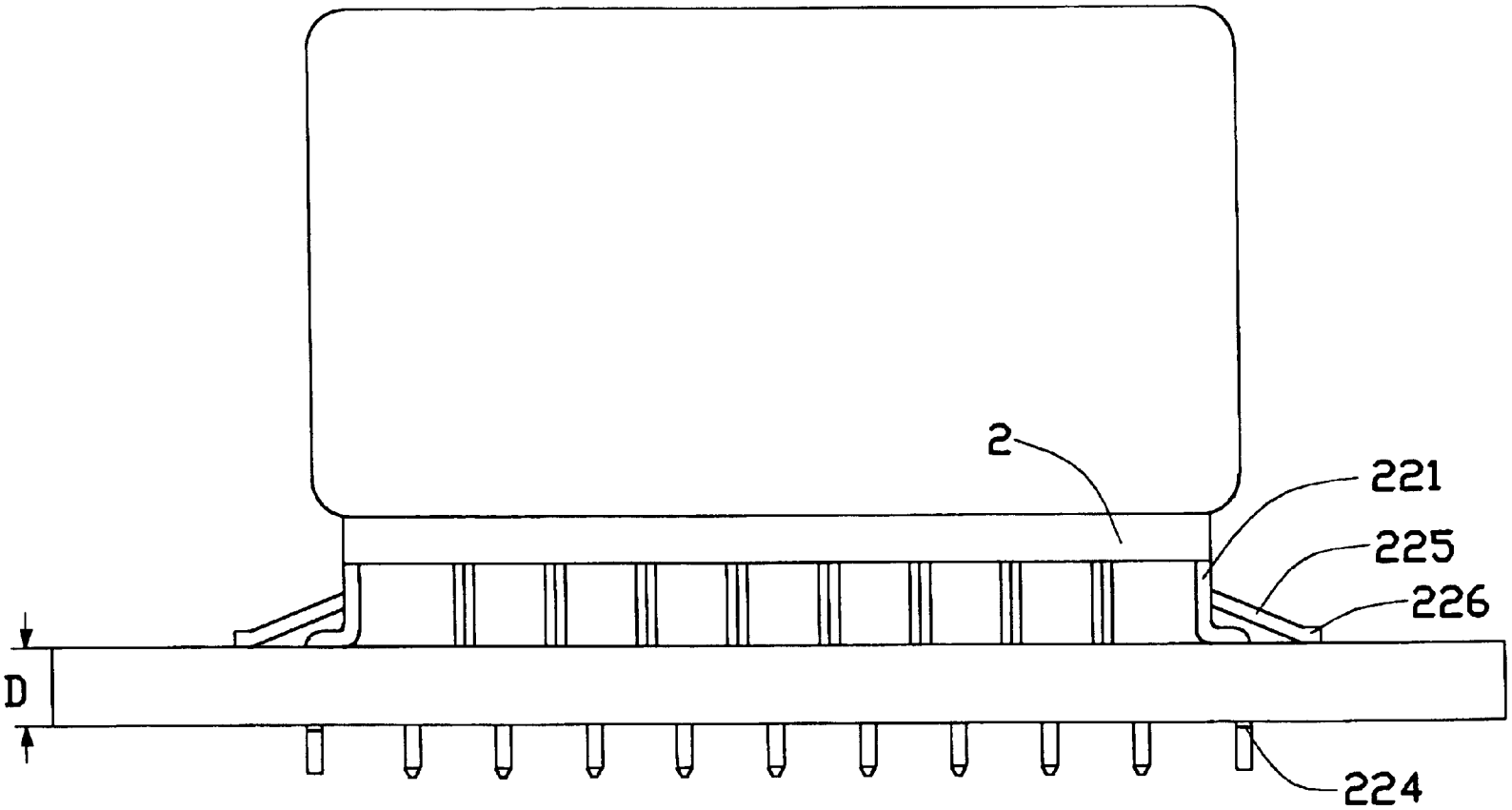
FIG. 4 is a side view of FIG. 3 and the thickness of the circuit board is labeled as D.

Also referring to FIGS. 3 and 4, when the electrical connector is assembled to a plug 5 mounted on the circuit board 4 and the thickness of the circuit board 4 is labeled as D, a plurality of contacts 51 of the plug 5 electrically contact the corresponding terminals of the electrical connector. The board locks 22 extend through corresponding receiving holes 41 formed in the circuit board 4. The barbs 224 engage a bottom surface of the circuit board 4, and the folded tip 226 of the resilient plate 225 elastically contacts a grounding pad 42 disposed on a top surface of the circuit board for electrically discharging static electricity accumulated on the circuit board 4. Thus, the electrical connector is secured to the circuit board 4 by the barbs 224 and the resilient plate 225.

Figure 5:
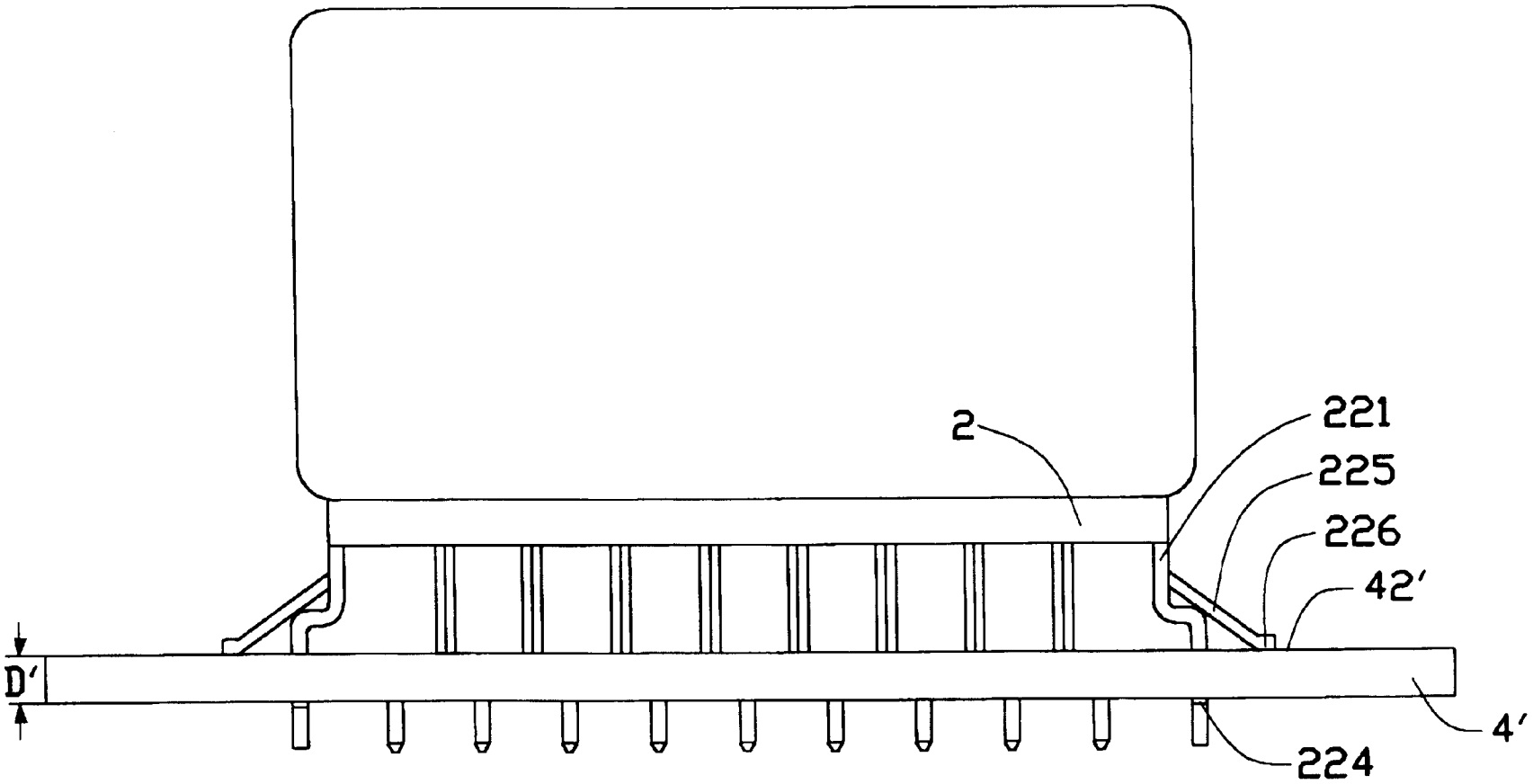
FIG. 5 is similar to FIG. 4 but with a circuit board of different thickness which is labeled as D'.

Referring to FIG. 5, due to the provision of the resilient plate 225, the electrical connector can be used with another circuit board 4' having a different thickness which is labeled as D'. During assembly, the resilient plate 225 is deformed when contacting a grounding pad 42', and the barbs 224 engage a bottom surface of the circuit board 4'. Thus, the electrical connector is properly secured to the circuit board 4' due to the resilient plate 225 and the barbs 224.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a body defining a plurality of passageways therein;

a plurality of terminals being retained in the corresponding passageways;

a shield defining a receiving space for enclosing the body; and a metal plate being secured to the shield and surrounding the body, a pair of board locks being formed on opposite lateral ends of the metal plate for securing to a circuit board, each board lock comprising a base, a pair of legs extending from opposite ends of the base, a barb formed on a free end of each leg, and a resilient plate extending from the base to electrically contact a grounding pad on the circuit board;

wherein the resilient plate sidewardly extends from a central portion of the base for imparting a predetermined spring force to the grounding pad of the circuit board;

wherein the barbs engage a bottom surface of the circuit board, and wherein the resilient plate contacts a top surface of the circuit board with a spring force when the electrical connector is assembled to the circuit board.

2. The electrical connector as claimed in claim 1, wherein the resilient plate forms a folded tip for electrically contacting the grounding pad of the circuit board.

3. An electrical connector assembly comprising:

a printed circuit board;

a connector mounted on the printed circuit board, said connector including:

an insulative body with a plurality of terminals therein;

a board lock downwardly extending at a bottom portion of the body, said board lock including:

a base and a pair of legs extending downwardly from said base, a barb formed on a free end of each of said legs, and a resilient plate extending from the base toward the barbs of the legs with vertical deflection capability, the resilient plate abutting an upper surface of the printed circuit board and the barbs abutting a lower surface of the printed circuit board so as to adjust to thickness differences of different printed circuit boards.

* * * * *